United States Patent [19]

Wolf et al.

[11] 4,241,867

[45] Dec. 30, 1980

[54] SLIDE RULE

[75] Inventors: Robert H. Wolf, Barrington; Madeleine L. Dugas, Palatine, both of Ill.

[73] Assignee: Graphic Calculator Company, Barrington, Ill.

[21] Appl. No.: 49,973

[22] Filed: Jun. 19, 1979

[51] Int. Cl.[3] ..... G06C 3/00

[52] U.S. Cl. ..... 235/85 R

[58] Field of Search ..... 235/70 A, 71 A, 70 R, 235/80, 85 R, 86, 89 R, 88

[56] References Cited

U.S. PATENT DOCUMENTS

| | | | |
|---|---|---|---|
| 1,410,195 | 3/1922 | Kopp | 235/85 R |
| 2,380,318 | 7/1945 | Kline | 235/85 R |
| 3,232,401 | 2/1966 | Jones | 235/88 |
| 3,352,031 | 11/1967 | Lindquist | 235/85 R |
| 3,451,619 | 6/1969 | Buck | 235/85 R |

*Primary Examiner*—L. T. Hix
*Assistant Examiner*—Benjamin R. Fuller
*Attorney, Agent, or Firm*—Norvell E. Von Behren

[57] ABSTRACT

A novel product selection slide rule is disclosed which allows the user of the slide rule to quickly determine which product from a grouping of products is best for a particular condition or property which he selects. The applicant's slide rule isolates the product best suited to the application out of a multiplicity of products and possibilities. The novel slide rule comprises a front and back cover with the front cover containing a plurality of viewing apertures and a plurality of stylus apertures. Between the front and back cover is positioned a central filler and a plurality of movable elongated slides are positioned within an elongated opening in the central filler. Each slide has formed thereon predetermined zones of different indicia for viewing through a plurality of viewing aperatures on the front cover.

6 Claims, 4 Drawing Figures

SLIDE RULE

BACKGROUND OF THE INVENTION

This invention relates generally to slide rules and in more particular to a product selection slide rule which may be quickly used to determine which product from a grouping of products would be acceptable for given conditions or properties.

It is known to have available to user of products, voluminous tables and charts which contained printed information in regard to each product manufactured by a particular company. In the selection of a necessary product, the purchaser of a product oftentime may be able to use several products from a supplier's inventory to meet a particular job. With all of the product's specifications contained on the voluminous charts and tables, it is oftentimes difficult to compare the products in regard to which products are suitable for various conditions and properties.

In order to aid the purchaser or user of the various products in his selection of the products, there has been provided by the applicant's invention a novel slide rule which enables him to quickly and easily make his desired selection of a product after reviewing the various conditions and properties that he may encounter in using the product.

SUMMARY OF THE INVENTION

The applicant's novel slide rule comprises a front and back cover which are rigidly fastened together and contain juxtaposed therebetween a central filler which has formed therein an elongated opening. Positioned within the central filler elongated opening are a pluality of movable elongated slides, each of which contains a stylus opening. Each slide has formed thereon predetermined zones of different indicia which are keyed to the various products in the product inventory and the indicia are viewed through the viewing apertures contained on the front cover. The slides are moved by inserting a stylus through stylus apertures into the stylus openings contained on the slides thereby utilizing the slide rule as will be more fully described hereinafter.

Accordingly it is an object and advantage of the invention to provide a new and novel slide rule which eliminates the use of standard tables and charts to ascertain which product is useful to a purchaser for various conditions or properties.

Another object and advantage of the invention is to provide a new and improved slide rule which contains novel structure that allows the slide rule to be utilized for various product selection uses.

These and other objects and advantages of the invention will become aparent from a review of the drawing attached herewith and from a reading of the specification and in particular from a reading of the description of the preferred embodiment.

DESCRIPTION OF THE PREFERRED EMBODIMENT

Figure 1:
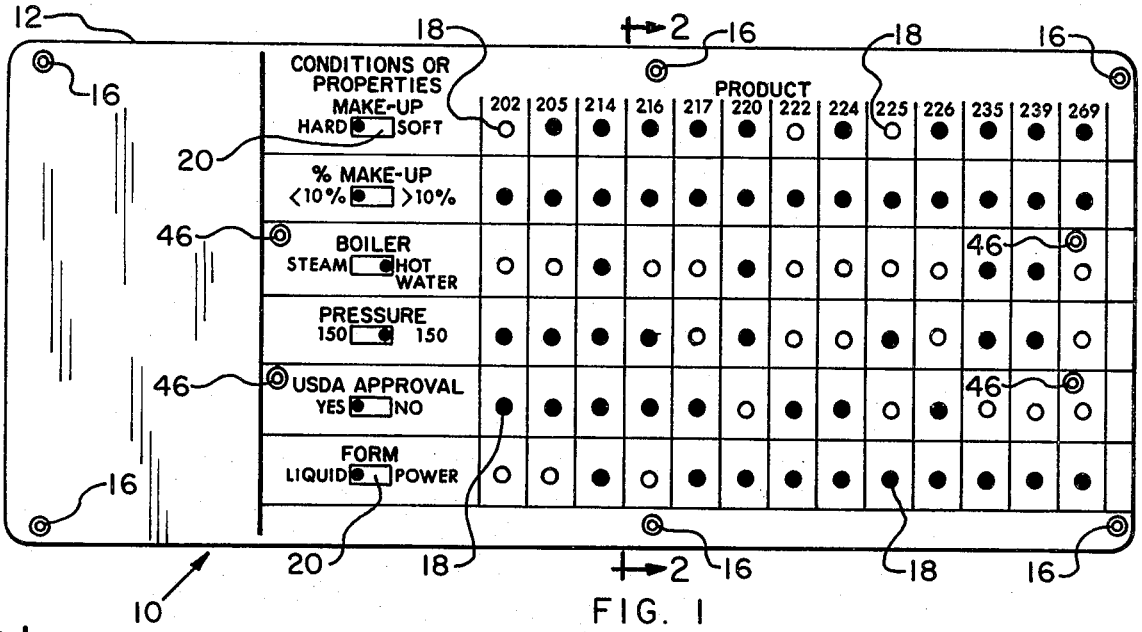
FIG. 1 is a plan view of the front cover of the applicant's novel slide rule showing the plurality of viewing apertures and the plurality of stylus apertures contained therein.
Figure 2:
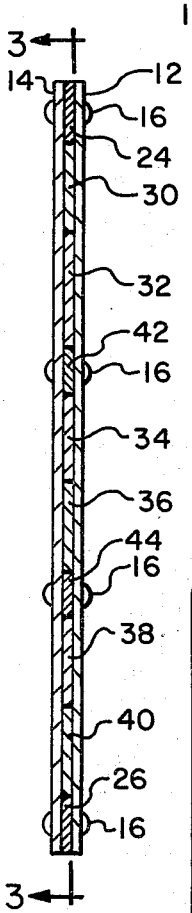
FIG. 2 is a sectional view, taken along line 2—2 of FIG. 1 showing the interior positioning of the plurality of movable elongated slides and further showing the front cover and back cover rigidly fastened together.

Referring now to the drawing in general and in particular to FIG. 1 of the drawing, there is shown the applicant's novel slide rule generally by the numeral 10 which comprises a front cover 12 which is rigidly fastened to a rear cover 14 shown more particularly in FIG. 2 of the drawing. The front cover 12 and the rear cover 14 are rigidly fastened together by fastening means such as a plurality of eyelets 16 or other fastening means of the type known in the slide rule art. It is within the spirit and scope of the invention that other fastening means may also be utilized and further the front cover 12 and the rear cover 14 may be constructed in a one-piece configuration which would be hinged about a dividing score line as is also known in the art.

The front cover 12 contains a plurality of viewing apertures 18 as well as a plurality of stylus apertures 20. The viewing apertures 18 may be formed in the preferred embodiment as a plurality of circular openings while the stylus apertures 20 may be formed in the shape of a rectangle as shown in FIG. 1 of the drawing.

Figure 3:
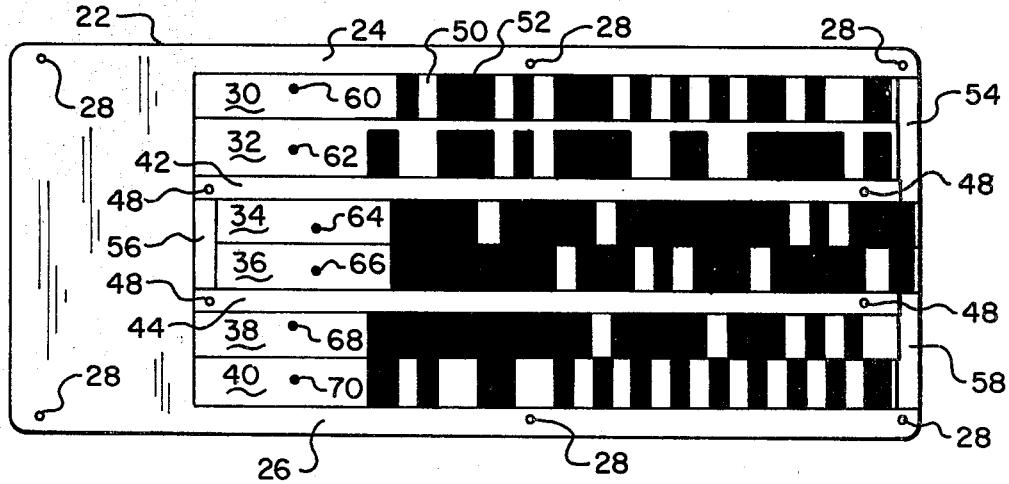
FIG. 3 is a sectional view, taken along line 3—3 of FIG. 2 showing the positioning of the plurality of movable elongated slides within the elongated opening of the central filler.

Referring now to FIG. 2 of the drawing there is shown a sectional view, taken along line 2—2 of FIG. 1 showing the fastening together of the front cover 12 and the rear cover 14 by means of the plurality of eyelets 16 as before mentioned. It will also be seen that there is contained between the front cover 12 and the rear cover 14 a central filler 22 of the configuration as shown in FIG. 3 of the drawing. The central filler 22 is formed in a general U-shape and has two spaced-apart legs 24 and 26 which are positioned at the top and bottom of the slide rule. The central filler 22 is retained between the front cover 12 and the rear cover 14 by means of the same eyelets 16 which are positioned through a plurality of openings 28 contained in the filler. The central filler 22 as well as the front cover 12 and the rear cover 14 are formed of paperboard in the preferred embodiment shown and may also be formed of plastic or some other suitable material as desired by the purchaser of the slide rule.

Between the front cover 12 and the rear cover 14 there is also positioned a plurality of movable elongated slides 30, 32, 34, 36, 38 and 40. In the embodiment shown in FIG. 3 of the drawing it will be noted that the slides 30–40 are grouped together in groupings of two and contain a separating filler 42 between the slides 32 and 34 and also a separating filler 44 between the slides 36 and 38. The fillers 42 and 44 may also be formed of paperboard or plastic or some other suitable material and are held in position between the front cover 12 and the rear cover 14 by means of a plurality of eyelets 46 positioned through the openings 48 contained in the fillers 42 and 44 and mating openings contained in the front cover 12 and the rear cover 14 (not shown on the drawing).

It will be seen that in the preferred embodiment shown the elongated slides 30–40 are positioned within the spaced-apart legs 24 and 26 and comprise at least six slides. However, it is within the spirit and scope of the invention that a greater or lesser number of slides may be positioned within the spaced-apart legs 26 and 28 as desired by the purchaser of the device.

It will also be noted when referring to FIG. 3 of the drawing that each slide 30–40 has formed thereon predetermined zones of light and dark indicia which may be viewed through the viewing apertures 18 whenever the slide rule is assembled. Each light and dark india indicates some predetermined product selection and are positioned on the slides 30–40 in predetermined positions so as to be precisely available for viewing through the viewing apertures 18. The zones of different indicia as herein described are shown in FIG. 3 by the numerals 50 and 52 when referring to slide 30. For example it can be seen that the zone 50 would be a light color while the zone 52 would be a dark color and accordingly the remaining portion of the slide would be colored in a predetermined manner for viewing through the viewing apertures 18 as will be described more fully hereinafter. When designing the particular indicia, the various product identifications are determined and the relative light and dark color of the indicia 50 and 52 and the length of the indicia on the slide is thereafter determined and the slide printed as desired.

It can be seen in FIG. 3 also how the slides 30–40 are movable between the legs 24 and 26 inasmuch as the slides 30 and 32 are shown positioned in the elongated opening to the extreme left leaving a void space 54 at the right end of the slide whereas the slides 34 and 36 have been positioned to the extreme right end leaving a void space 56 at the extreme left end of the slide. In a similar manner the slides 38 and 40 have been shown positioned to the extreme left end of the opening leaving a void space 58 at the extreme right end of the calculator.

Figure 4:
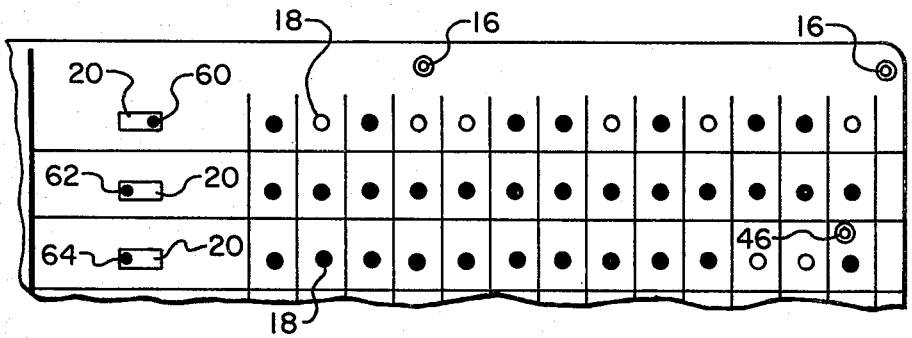
FIG. 4 is an enlarged plan view of the front cover of the novel slide rule shown in FIG. 1 showing how the slide rule would be utilized by the movement of the elongated slides as will be described more fully hereinafter.

The slides 30–40 also contain stylus openings 60, 62, 64, 66, 68 and 70 as shown in FIG. 3 of the drawing. It should become apparent from a review of the drawing figures that when the slide rule 10 is assembled as shown in FIG. 1 of the drawing that the stylus openings 60–70 are aligned beneath the stylus apertures 20 and the slides 30–40 are movable within the elongated opening a predetermined distance as controlled by the length of the stylus apertures 20. The movement of the slides is accomplished by the insertion of a stylus through the desired stylus aperture 18 into the aligned stylus openings 60, 62, 64, 66, 68 or 70 as chosen by the user of the device. This condition is shown in FIG. 4 of the drawing wherein there is shown the top three groupings of slides in a position different than that shown in FIG. 1 of the drawing and it can be seen how for example slide 30 has been repositioned to the right and in a similar manner slide 34 has been repositioned to the left.

In the embodiment shown in the drawings, the purchaser of the device was desirous of indicating six conditions or properties of the water supply in a water treatment system and was desirous of providing information regarding thirteen products which were designated by various numerals starting with the numeral 202 and ending with the numeral 269. In using the device it can be seen for example that by positioning the stylus opening 60 to either the condition "hard" or "soft" the user is quickly able to determine which of the thirteen products are satisfactory to change the condition of the make-up water in the water treatment system. In a similar manner by the positioning of the slide 32 to the percent of make-up desired from greater than 10% to less than 10% he can also determine which product to utilize.

It can be seen that the applicant's novel slide rule may be utilized for many other applications of product selection and the applicant is not to be limited to the exact product selection shown in the embodiment and the exact structural details shown therein which have been shown by way of illustration only. It is understood that changes may be made in the various parts of the slide rule without departing from the spirit and scope of the invention and applicant is not to be limited to the embodiment shown.

Having described our invention, we claim:

1. A slide rule comprising:

(a) a back cover;

(b) a front cover having formed therein a plurality of viewing apertures and a plurality of stylus apertures;

(c) a central filler positioned between the front and back cover and having formed therein an elongated opening;

(d) means, associated with the front and back cover and the central filler, for rigidly fastening the covers and the filler together; and (e) a plurality of movable elongated slides positioned within the elongated opening and having formed therein stylus openings, each slide also having formed thereon pre-determined zones of different indicia for viewing through the viewing apertures.

2. The slide rule as defined in claim 1 wherein the central filler is formed in a general U-shape having two spaced apart legs positioned at the top and bottom of the slide rule.

3. The slide rule as defined in claim 2 wherein the plurality of elongated slides are positioned within the spaced apart legs and comprise at least six slides.

4. The slide rule as defined in claim 3 further comprising the six slides being positioned in groups of two slides with a spacer being positioned between adjacent groups.

5. The slide rule as defined in claim 1 wherein the pre-determined zones of different indicia are alternating shades of light and dark color to indicate pre-determined product selections.

6. The slide rule as defined in claim 1 wherein the slides are positioned within the elongated opening so that the stylus openings are aligned beneath the stylus apertures and are movable within the elongated opening a pre-determined distance by insertion of a stylus through the desired stylus aperture into the aligned stylus opening.

* * * * *